US005251753A

United States Patent [19]

Pigott et al.

[11] Patent Number: 5,251,753

[45] Date of Patent: Oct. 12, 1993

[54] COMBINED PRODUCT SHIPPING AND DISPLAY UNIT

[75] Inventors: Daniel Pigott, Andover; John Davis, River Edge, both of N.J.

[73] Assignee: BASF Corporation, Parsippany, N.J.

[21] Appl. No.: 965,453

[22] Filed: Oct. 23, 1992

[51] Int. Cl.[5] ..... B65D 19/00

[52] U.S. Cl. ..... 206/386; 206/44 R; 206/586; 206/597

[58] Field of Search ..... 206/44 R, 45.13, 45.28, 206/386, 427, 430, 453, 597, 586, 600, 821; 248/174

[56] References Cited

U.S. PATENT DOCUMENTS

| | | | |
|---|---|---|---|
| 4,615,443 | 10/1986 | Deffner et al. | 206/427 |
| 4,638,941 | 1/1987 | Watson | 206/821 |
| 4,667,823 | 5/1987 | Wolfe, Jr. et al. | 206/821 |
| 4,697,699 | 10/1987 | Schneider | 206/44 R |
| 4,813,536 | 3/1989 | Willis | 206/44 R |
| 4,998,619 | 3/1991 | Sowa et al. | 206/386 |
| 5,035,323 | 7/1991 | Daniels et al. | 206/386 |
| 5,042,665 | 8/1991 | Liebel | 206/386 |
| 5,154,297 | 10/1992 | Farley | 206/453 |
| 5,161,692 | 11/1992 | Knierim | 206/586 |

FOREIGN PATENT DOCUMENTS

| | | | |
|---|---|---|---|
| 2311364 | 3/1973 | Fed. Rep. of Germany | 206/44 R |
| 9204239 | 3/1992 | PCT Int'l Appl. | 206/44 R |

*Primary Examiner*—David T. Fidei
*Attorney, Agent, or Firm*—Nixon & Vanderhye

[57] ABSTRACT

Shipping/display units include a number of vertically stacked product-containing trays supporting upright dividers which maintain separation between the product containers. When in its shipping condition, the bottom-most tray is nestably received within a pallet skirt which rests upon a conventional wooden shipping pallet. Each tray is provided with an individual corner support member which extends between an adjacent pair of vertically separated trays. A corner post extending the entire height of the unit is positioned at each corner of the unit to provide additional structural support during shipping. To further enhance the aesthetic appeal of the display the pallet skirt may be reverse folded so as to lie against respective vertical sides of the pallet and is maintained in that position by cooperating locking tongues and slits formed in the pallet skirt side walls. A display insert having a pair of opposed feet and a central tongue element may be positioned on an edge of the uppermost tray/divider assembly so as to enhance the aesthetic appeal of the unit when in its display condition.

10 Claims, 4 Drawing Sheets

COMBINED PRODUCT SHIPPING AND DISPLAY UNIT

RELATED APPLICATIONS

This application is related to U.S. Des. patent application Ser. No. 002,204 filed even date herewith, the entire content of which is expressly incorporated hereinto by reference.

FIELD OF INVENTION

This invention is generally related to an assembly by which consumer products may be shipped safely by a manufacturer to a point of purchase retailer, and then to efficiently display the product in an aesthetically pleasing manner at such point of purchase.

BACKGROUND AND SUMMARY OF THE INVENTION

Many products are individually packaged for sale to the ultimate consumer. Such prepackaged products, however, are typically shipped to the point of sale retailer in bulk form —i.e., within their own shipping container. Of course, it is quite important for the product manufacturer to devise a shipping container which ensures that the prepackaged product will not be damaged in transit. It is also quite important for the product to be displayed in an efficient and aesthetically pleasing manner so as to attract consumer awareness. Oftentimes, the point of purchase retailer will physically remove the prepackaged products from their shipping container and place them on store shelves and/or in stacked island displays on the sales floor.

Those in this art have, however, endeavored to provide shipping assemblies which also serve as product displays at the point of purchase, as evidenced by U.S. Pat. Nos. 4,919,270 to Govang et al; U.S. Pat. No. 5,035,323 to Daniels et al; U.S. Pat. No. 5,016,761 to Stoddard et al; U.S. Pat. No. 4,705,162 to Kupersmit; and U.S. Pat. No. 4,638,941 to Watson. While the combined shipping and display assemblies proposed in the art are satisfactory for many prepackaged products, other products, such as prepackaged containers of flowable (e.g., fluid or granulated) product require special packaging considerations. It is therefore towards providing a combined shipping and display unit which is especially adapted for use with prepackaged containers of flowable product that the present invention is directed.

The shipping/display unit according to the present invention includes a number of vertically stacked trays supporting upright dividers which maintain separation between the product containers. When in its shipping condition, the bottom-most tray is nestably received with a pallet skirt which rests upon a conventional wooden shipping pallet. Any number of vertically stacked tray/divider assemblies will form the shipping-/display unit of this invention, but preferably four such tray/divider assemblies will be provided.

To protect the product containers during shipping, each tray is provided with an individual corner support member which extends between an adjacent pair of vertically separated trays. A corner post extending the entire height of the unit is positioned at each corner of the shipping/display unit to provide additional structural support during shipping. The opposing end sections of each corner post are respectively received within the pallet skirt and an upper cap. A display board and top pad are provided between the upper tray/divider assembly and the cap. The entire unit is then "shrink-wrapped" with a suitable transparent plastics film and shipped to the point of sale retailer.

Upon receipt of the shipping/display unit, the retailer will prepare it for floor display. In this connection, the shrinkwrapped film, upper cap and corner protectors (i.e., the individual corner supports and the elongate corner posts) will be removed and discarded. The product containers will therefore be visible to the retail consumer in the form of stacked layers separated by the dividers.

To further enhance the aesthetic appeal of the display, the pallet skirt is reversed by downwardly folding its side walls so as to lie against respective vertical sides of the pallet. Reverse folding of locking tongue structures associated with an opposed pair of side walls and their reinsertion into an associated slot of an adjacent side wall will then positively lock the pallet skirt against the vertical sides of the pallet, thereby visually obscuring the otherwise unsightly pallet. A display insert having a pair of opposed feet and a central tongue element is then positioned on an edge of the upper-most tray/divider assembly. The individual product containers will thus be displayed in an efficient and aesthetically pleasing manner to the retail consumer.

Further aspects and advantages of this invention will become more clear after careful consideration is given to the following detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein.

Figure 4:
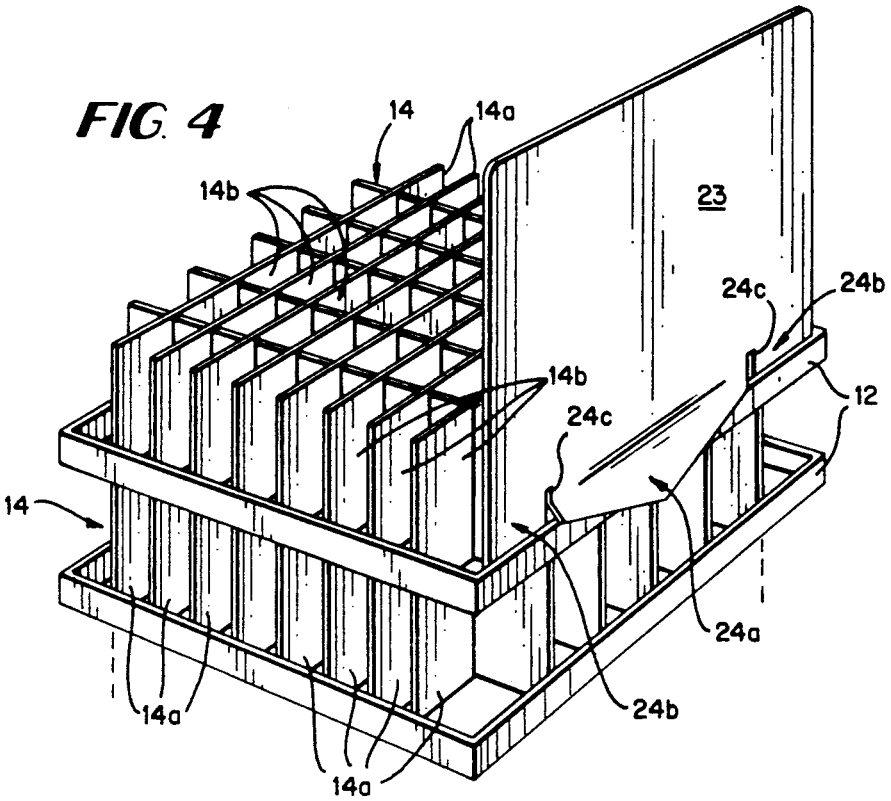
Figure 5A:
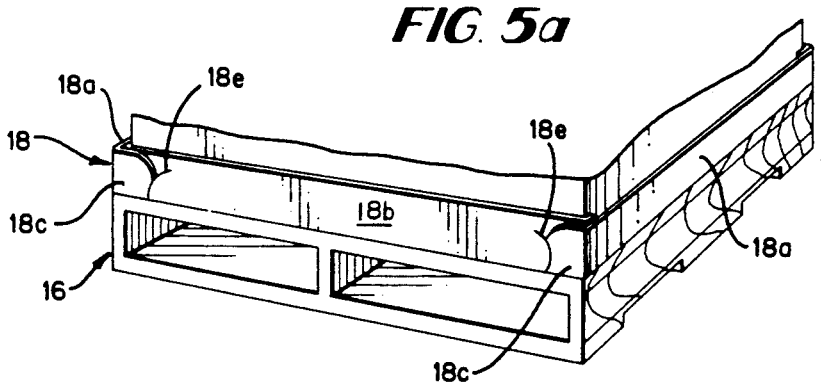
Figure 5B:
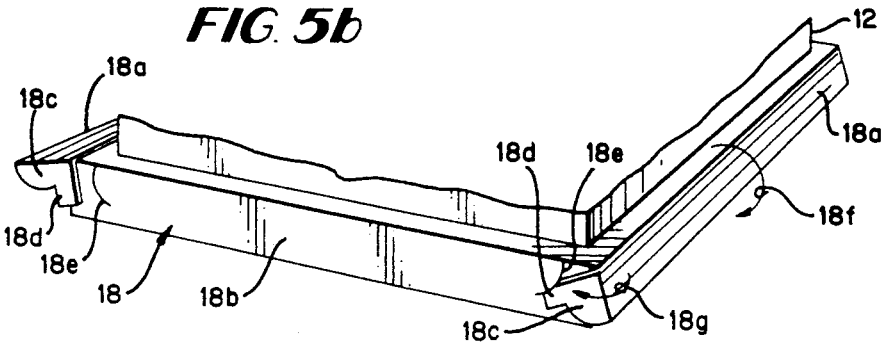

FIG. 4. is a rear partial perspective view particularly showing a display insert board that may be employed to enhance the aesthetic appeal of the shipping/display unit; and FIG. 5*a* and 5*b* are partial perspective views showing the manner in which the pallet skirt is changed from its shipping state to its display state.

DETAILED DESCRIPTION OF THE PREFERRED EXAMPLARY EMBODIMENTS

Figure 1:
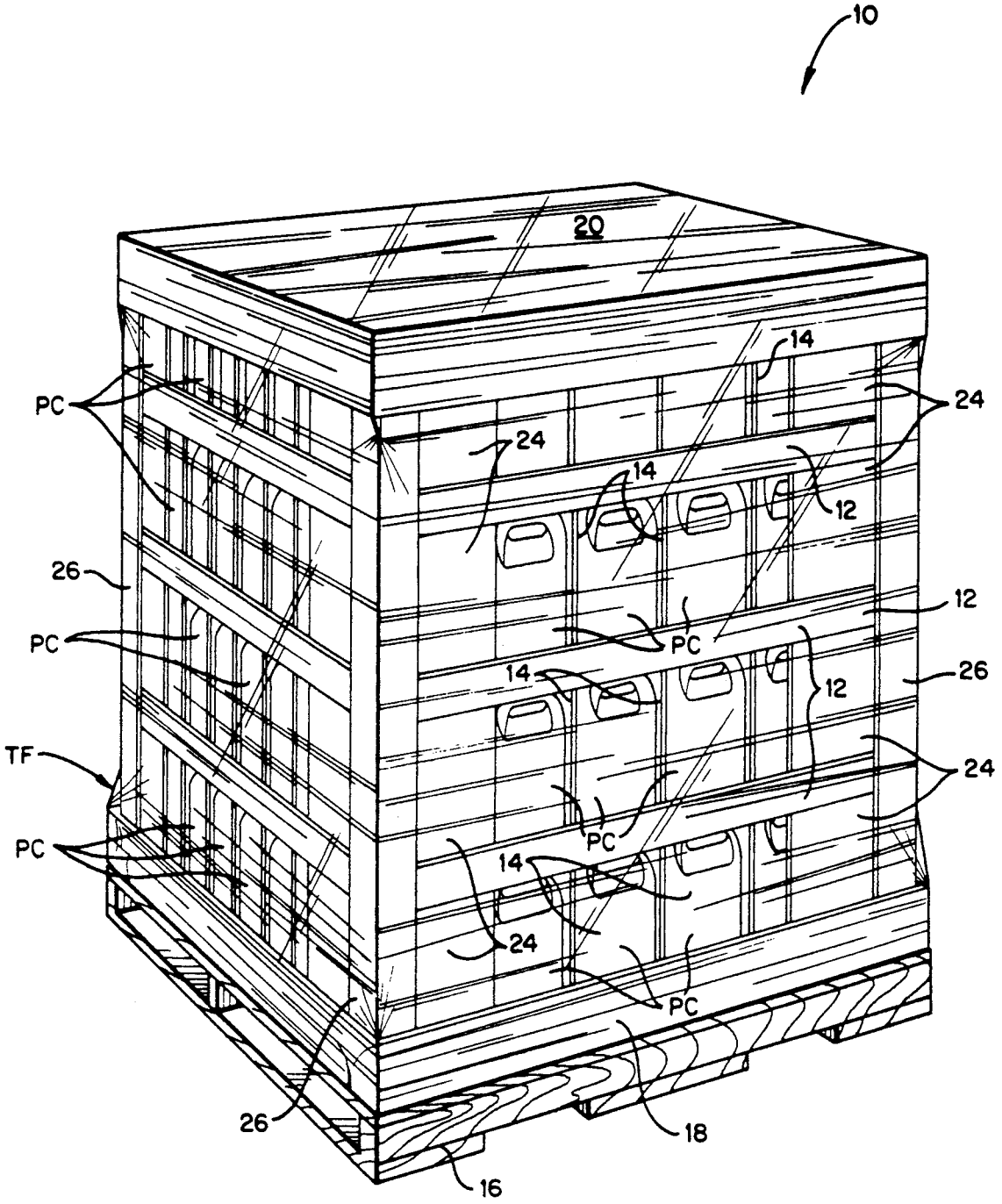
FIG. 1 is a perspective view of a combined product shipping and display unit according to this invention which is depicted in its shipping condition.
Figure 2:
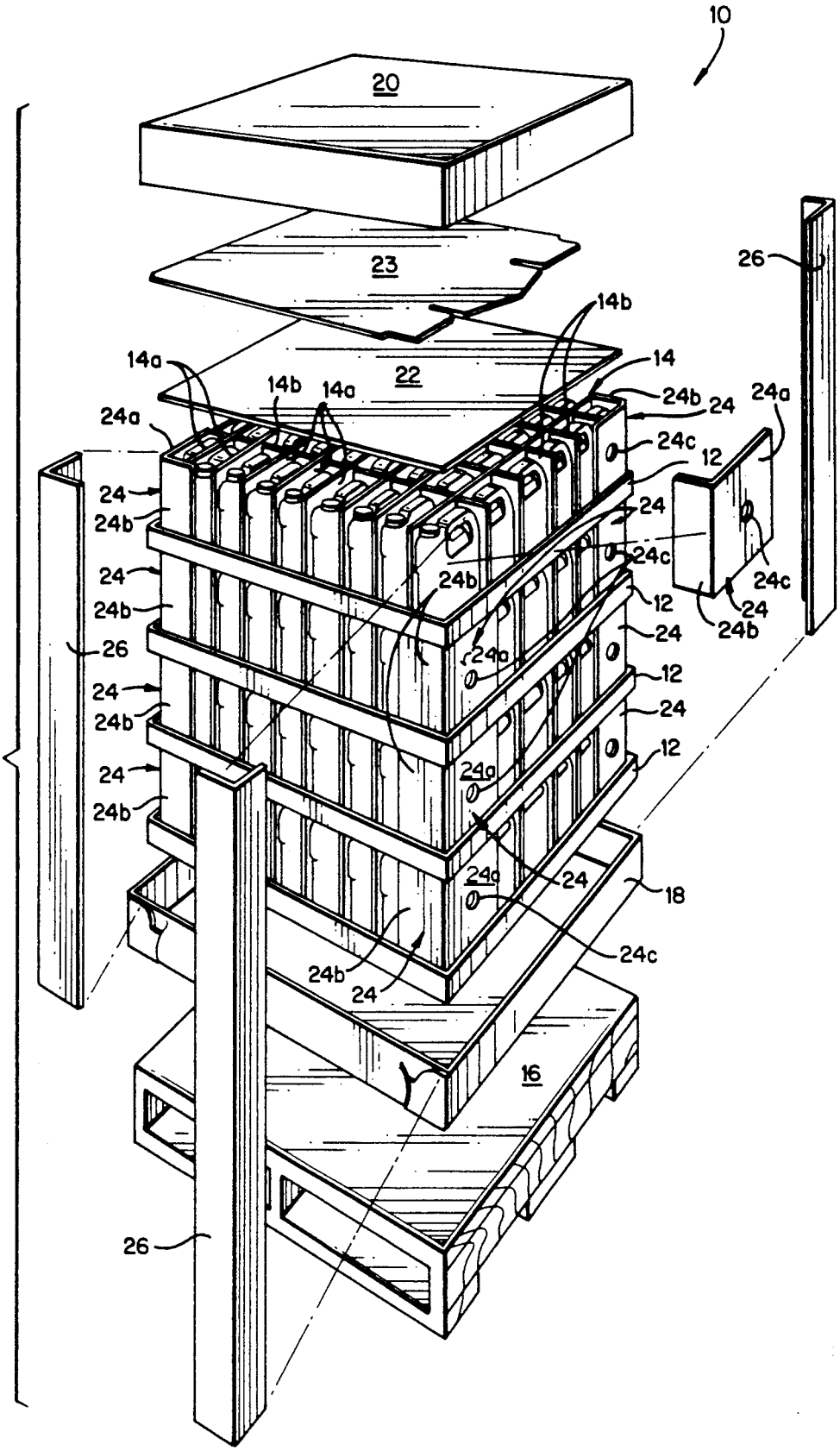
FIG. 2 is an exploded perspective view of the combined product shipping and display unit according to this invention showing more clearly the various structural components thereof.

Accompanying FIGS. 1 and 2 show the combined shipping/display unit 10 according to this invention in its shipping condition, with FIG. 2 being an exploded view to better depict the structural components thereof. In this connection, the unit 10 is composed of a number of individual product containers PC which in the preferred embodiment are plastic bottles which contain a flowable product (e.g., liquid automotive antifreeze). The product containers rest upon a respective one of the trays 12 which are, in and of themselves conventional (e.g., formed from a blank similar to that shown in FIG. 8 of U.S. Pat. No. 4,919,270 to Govang et al, the entire content of which is expressly incorporated hereinto by reference).

the array of product containers PC within respective trays 12 are separated from one another by means of a divider assembly 14 (see FIG. 2). The divider assembly 14 is itself comprised of interleaved lengthwise and widthwise extending divider boards 14*a* and 14*b*, respectively, which subdivide the interior space of each tray 12 into a selected m x n array corresponding to the desired array for the product containers PC. A number of such vertically stacked tray/divider/product containers assemblies will therefore define the height of the unit 10.

Figure 3:
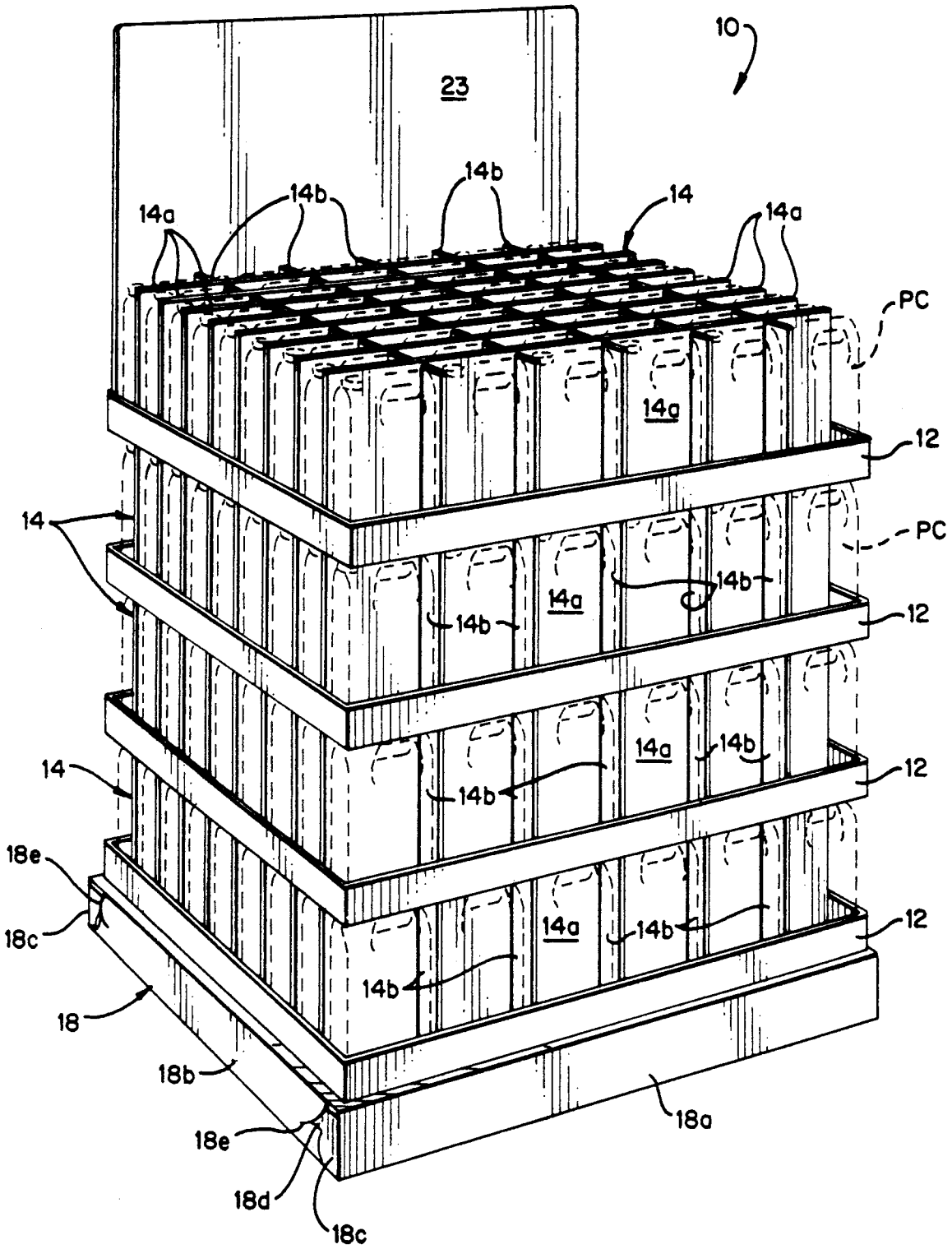
FIG. 3 is a perspective view of the combined product shipping and display unit according to this invention which is depicted in its display condition.

The vertically stacked tray/divider/product container assemblies rest upon a conventional wooden pallet 16 which facilitates movement of the entire unit by suitable equipment (e.g., fork-lift trucks). The bottom-most tray 12 (not visible in FIG. 1, but see FIG. 2) is nestably received within a pallet skirt 18, the functions and purpose of which will be explained in greater detail below. Suffice it to say here, however, that the pallet skirt 18 is shown in FIGS. 1 and 2 as being in its shipping state, but may be reversibly folded and positioned adjacent to the pallet sided (e.g., as shown in FIG. 3) so as to visually hide the otherwise unsightly pallet 16.

The upper-most tray/divider/product container assembly is nested within a cap structure 20 which forms a protective top cover for the unit 10. In this regard, a boxboard pad 22 and a product display board 23 (e.g., containing appropriate product logos and advertisements) and provided between the upper-most tray/divider product container assembly and the cap structure 20, as is shown more clearly in FIG. 2.

During shipment of the unit 10, it is especially desirable to increase the structural integrity of the vertically stacked layers of trays 12, dividers 14, and product containers PC. According to this invention, increased structural integrity for the unit 10 is provided by a two-component corner protection system. As is shown in FIG. 2, the corner protection system includes individual corner supports 24 associated with each tray 12 and elongate corner posts 26. The corner supports 24 and posts 26 are, moreover, provided at each corner of the unit 10, even though only three such corners are visible in FIG. 2.

The individual corner supports 24 are longitudinally folded so as to form a right angle member having a relatively longer side 24*a* 29 and a relatively shorter side 24*b*. The longer side and shorter sides 24*a*, 24*b* are dimensioned so as to be at least comparable to, and preferably greater than, the dimension of the width and depth dimensions, respectively, of the product containers PC occupying the corner position in each tray 12. As a result, those product containers PC occupying the corner positions of each tray 12 will be bounded completely by boxboard structural supports—i.e., on two adjacent sides by the divider 14 and on the remaining two adjacent sides by the corner support 24. This bounding of the corner product containers PC by boxboard structural supports thus serves to enhance the structural integrity of the overall unit 10. Preferably, one (or both) of the sides 24*a*, 24*b* have an aperture 24*c* which facilitates removal of the corner support 24 when the unit 10 is prepared for display purposes.

The elongate corner posts 26 are, like the individual corner supports, longitudinally folded right angle boxboard structures which extend the entire height of the unit 10. In this regard, the lower end region of the corner posts 26 will be captured between the pallet skirt and the bottom-most tray 12, while the upper and region of the corner posts 26 will be captured between the cap 20 and the corner product containers PC. The thus formed unit 10 may then be "shrink-wrapped" with a suitable thermoplastic film TF (see FIG. 1) and shipped to the point of purchase retailer.

Upon arrival at the point of purchase retailer, the unit 10 may then be prepared for display of the product containers PC. The display condition of the unit 10 is shown in accompanying FIG. 3. As is seen, the shrink-wrapped film TF, corner supports 24, corner posts 26 and pad 22 are discarded or recycled when the retailer converts the unit 10 to its display condition. The display board 23 is then erected along one edge (preferably the rear edge) of the uppermost tray 12.

Accompanying FIG. 4 is a partial rear perspective view of the unit 10 and shows the manner in which the display board 23 is attached to the rear edge of the uppermost tray 12. In this regard, the lower end of the display board 23 is most preferably formed with a central depending tongue element 24*a* and a pari of depending feet 24*b* on each lateral side of the tongue element 24*a* which are established by means of vertical slits 24*c* formed in the display board 23. The feet 24*b* are thus positioned on the interior edge of the uppermost tray 12, while the tongue element 24*a* is positioned adjacent the exterior edge of the tray 12. This alternating interior and exterior positioning of the feet 24*b* and tongue element 24*a* will thus provide a friction fit engagement between the lower end region of the display board 23 and the uppermost tray 12. As a result, the display board 23 is maintained in an upright condition as shown in FIGS. 3 and 4.

It will also be observed in FIG. 3 that the pallet skirt 18 of the unit 10 will be repositioned so that the pallet 16 is visually hidden when the unit 10 is in its display condition. Accompanying FIGS. 5*a* and 5*b* depict the manner by which the retailer will reposition the pallet skirt 18 according to this invention.

In this connection, the pallet skirt 18 when received by the retailer will be in the condition shown in FIG. 5*a*. That is, the pallet skirt will include opposed pairs of side walls 18*a*, 18*b* (only one of the side walls 18*b* being shown in FIG. 5*a*, but is representative of the other side wall 18*b* not shown). Each of the ends of side walls 18*a* terminate in a respective locking tab 18*c* having an outwardly projecting locking tongue member 18*d*. The locking tongue members 18*d*, in turn, are inserted into cooperating arcuate slits 18*e* formed at each end of the side walls 18*b* so as to maintain the pallet skirt in its shipping condition as shown in FIG. 5*a*.

In order to hide the pallet 16, therefore, the retailer simply needs to disengage the locking tongue members 18*d* from their respective slits 18*e* and reverse fold (e.g., downwardly as shown by arrow 18*f* in FIG. 5*b*) so that all of the side walls 18*a* and 18*b* lie adjacent a respective side of the pallet 16. The locking tabs 18*c* are similarly reverse folded (e.g., in the direction of arrow 18*g* shown in FIG. 5*b*) from their condition shown in FIG. 5*a* so that they are again realigned with a respective one of the slits 18*e*. The locking tongue members 18*d* may then be reinserted into their respective adjacent slit 18*e* so as to retain the skirt in its display condition as shown in FIG. 3.

As is now apparent, the combined shipping/display unit 10 according to this invention allows prepackaged product to be safely shipped to a point of sale retailer, and then permits that product to be displayed efficiently and in an aesthetically pleasing manner. Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

WHAT IS CLAIMED IS:

1. A combined product shipping and display unit comprising:

a pallet;

a pallet skirt disposed on said pallet and having opposed pairs of side walls which are upwardly positioned when in a shipping condition so as to expose corresponding sides of said pallet, and which may be reverse folded so as to be downwardly positioned so as to hide said corresponding sides of said pallet when in a display condition;

a number of vertically stacked product container layers supported upon said pallet, each said product container layer including (i) a selected number of product containers arranged in a predetermined array, (ii) a horizontal tray defining an interior area for supporting the array of product containers therewithin, and (iii) a vertical divider assembly including interleaved lengthwise and widthwise extending divider boards for separating one product container from another and for establishing said predetermined array of said product containers supported within said interior area of said tray;

a cap structure covering an uppermost one of said product container layers, wherein a bottom-most one of said product container layers is nestably received within said pallet skirt when in a shipping condition; and a corner protector assembly disposed at each corner of the shipping and display unit which includes (a) longitudinally folded right angle corner supports vertically extending between adjacent trays of said product container layers, and (b) an elongate longitudinally folded right angle corner post which is positioned exteriorly adjacent said corner supports and extends between said pallet skirt and said cap structure.

2. A combined product shipping and display unit as in claim 1, wherein said corner supports include relatively longer and shorter legs which, together with a respective corner of said interleaved divider boards, collectively bound a product container at each said corner of said product container layers.

3. A combined product shipping and display unit as in claim 1, wherein said corner supports include at least one aperture which facilitates removal of said corner support when said unit is changed from said shipping condition to said display condition.

4. A combined product shipping and display unit as in claim 3, wherein said corner supports include relatively longer and shorter legs which, together with a respective corner of said interleaved divider boards, collectively bound a product container at each said corner of said product container layers.

5. A combined product shipping and display unit as in claim 4, wherein said at least one aperture is formed in said relatively longer leg of said corner supports.

6. A combined product shipping and display unit as in claim 1, wherein each end of one pari of said side walls of said pallet skirt includes a locking tab having an outwardly projecting locking tongue, and wherein each end of the other pair of said side walls includes a slit which is sized and configured to receive therewithin a respective said locking tongue, whereby said pallet skirt may be retained in said shipping and display conditions.

7. A combined product shipping and display unit as in claim 1, further comprising a display board positioned between said uppermost one of said product container layers and said cap structure when said unit is in said shipping condition, and adapted to being erected along an edge of said tray associated with said uppermost one of said product container layers when said unit is in said display condition.

8. A combined product shipping and display unit as in claim 7, wherein said display board includes a central depending tongue element, and a pair of depending feet disposed on each side of said tongue element, said feet and said tongue element being positioned on interior and exterior edges, respectively, of said uppermost one of said product container layers when said unit is in said display condition, whereby said display board is erected.

9. A combined product shipping and display unit as in claim 8, wherein said depending feet of said display unit are established by respective vertical slits formed in said display board.

10. A combined shipping and display unit as in claim 1, further comprising a shrink wrapped thermoplastic film covering exterior sides of said unit when in said shipping condition.

* * * * *